United States Patent [19]

Ito

[11] 4,304,007

[45] Dec. 8, 1981

[54] JACKET

[76] Inventor: Mitsuru Ito, 322 E. 55th St., Apt. 3B, New York, N.Y. 10022

[21] Appl. No.: 35,960

[22] Filed: May 4, 1979

[51] Int. Cl.[3] ..... A41D 1/02; A41D 1/22

[52] U.S. Cl. ..... 2/74; 2/108; 2/90

[58] Field of Search ..... 2/108, 75, 74, 80, 243 R, 2/243 B, 90, 73

[56] References Cited

U.S. PATENT DOCUMENTS

| | | | |
|---|---|---|---|
| 1,256,736 | 2/1918 | Sheehy | 2/80 |
| 1,292,703 | 1/1919 | Carter | 2/80 |
| 1,309,487 | 7/1919 | Reeser et al. | 2/75 |
| 1,372,189 | 3/1921 | Pollock | 2/75 |
| 1,524,345 | 1/1925 | DuBose | 2/75 |
| 1,797,604 | 3/1931 | Bungdorfer | 2/75 |
| 2,426,282 | 8/1947 | Owen | 2/75 X |
| 3,568,213 | 3/1971 | Mason | 2/80 |

FOREIGN PATENT DOCUMENTS

| | | | |
|---|---|---|---|
| 1460026 | 2/1969 | Fed. Rep. of Germany | 2/75 |

*Primary Examiner*—H. Hampton Hunter
*Attorney, Agent, or Firm*—Ladas & Parry

[57] ABSTRACT

A jacket or similar garment is made from a single, main blank and two gusset blanks. The main blank has a neck opening and has a front panel, a back panel and two sleeve portions all extending from the neck opening. The gusset blanks are of square, diamond or kite-like form and each has four sides. A first side of each gusset blank is secured to one of two lateral edges of the front panel of the main blank, a second side of each gusset blank is secured to one of two lateral edges of the back panel, and the third and fourth sides of each gusset blank are secured to the lateral edges of the sleeve portions. The lateral edges of each sleeve portion are secured together from the corner between the third and fourth sides of the gusset blank to the cuff edge, and each lateral edge of the front panel is secured to a corresponding lateral edge of the rear panel from the corner between the first and second sides of the gusset blank to the bottom edges of the front and back panels.

21 Claims, 7 Drawing Figures

FIG. 1
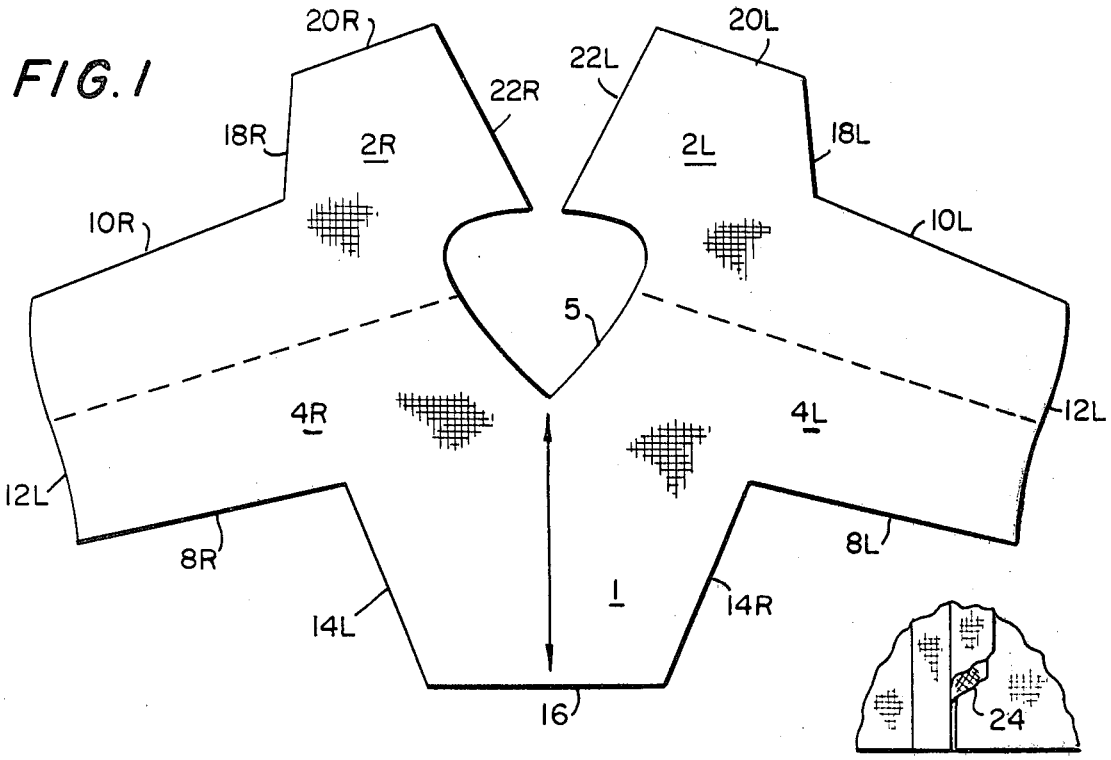
FIG. 1a
FIG. 1b
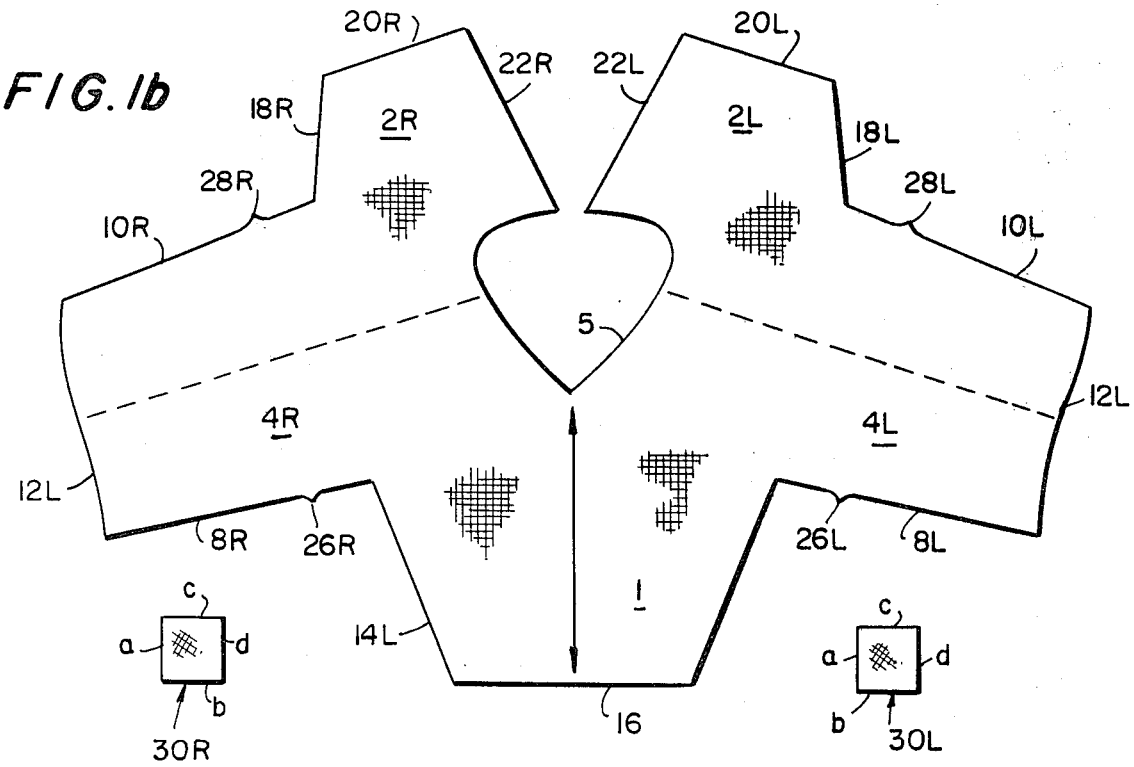

JACKET

This invention relates to methods of making jackets or similar garments, and garments made by the method.

According to a first aspect of the present invention there is provided a method of making a jacket or similar garment using sheet-form flexible material, comprising the steps of (a) forming a single blank having a neck opening and having a front panel portion, a back panel portion and two sleeve portions all extending from said neck opening, said front panel portion and said rear panel portion each being bounded by a bottom edge and two lateral edges, and said sleeve portions each being bounded by a cuff edge and two lateral edges, and at least one of said panel portions being divided into two parts which are bounded respectively by inner edges extending in mutually converging relationship from said bottom edge to the neck opening; and (b) securing the lateral edges of each sleeve portion together, to form a sleeve terminating at said cuff edge, and securing each lateral edge of the front panel portion to a corresponding lateral edge of the rear panel portion.

According to a second aspect of the present invention there is provided a method of making a jacket or similar garment using sheet-form flexible material, comprising the steps of:

(a) forming a single, main blank having a neck opening and having a front panel portion, a back panel portion and two sleeve portions all extending from said neck opening, said front panel portion and said rear panel portion each being bounded by a bottom edge and two lateral edges, and said sleeve portions each being bounded by a cuff edge and two lateral edges, and at least one of said panel portions being divided into two parts which are bounded respectively by inner edges extending in mutually converging relationship from said bottom edge to the neck opening;

(b) forming first and second gusset blanks of square, diamond or kite-like form having four sides, a front and a second side of each gusset blank being adjacent and of equal length, and a third and the fourth side of each gusset blank being adjacent and of equal length and being adjacent the first and second sides respectively of the gusset blank;

(c) securing the first side of each gusset blank to one of the two lateral edges of the front panel portion with the corner between the first and third sides disposed at the junction of the lateral edge of the front panel portion and the adjacent lateral edge of one of the two sleeve portions;

(d) securing the second side of each gusset blank to one of the two lateral edges of the back panel portion with the corner between the second and fourth sides disposed at the junction of the lateral edge of the back panel portion and the adjacent lateral edge of one of the two sleeve portions;

(e) securing the third side of each gusset blank to the adjacent lateral edge recited in step (c) and securing the fourth side of each gusset blank to the adjacent lateral edge recited in step (d); and (f) securing the lateral edges of each sleeve portion together from the corner between the third and fourth sides of the gusset blank to the cuff edge and securing each lateral edge of the front panel portion to a corresponding lateral edge of the rear panel portion from the corner between the first and second sides of the gusset blank to the bottom edges of the front and rear panel portions.

According to a third aspect of the present invention there is provided a method of making a jacket or similar garment from sheet-form flexible material, comprising the steps of:

(a) forming a single blank bounded by three major edges and having a neck opening and also having a back region, a front region and two sleeve regions, the front region being in two portions bounded by first parts of a first and a second of said major edges respectively and also being bounded by respective inner edges which extend from adjacent ends of said first and second major edges to the neck opening, the back region being bounded by a first part of the third major edge, and the sleeve regions being bounded by respective parts of the third major edge, parts of the first and second major edges respectively, and respective cuff edges;

(b) forming a second blank having two major edges and two minor edges, one of the major edges having an intermediate region substantially equal in length to said first part of the third major edge of the first blank and two end regions substantially equal in length to said first parts of said first and second major edges respectively, and the other major edge having three regions extending substantially parallel respectively to the three regions of said one major edge;

(c) securing the intermediate region and the two end regions of said one major edge of the second blank to, respectively, said first part of the third major edge of the first blank and said first parts of the first and second major edges of the first blank, securing together the parts of the first and third major edges of the first blank bounding one sleeve region and the parts of the second and third major edges of the first blank bounding the other sleeve region.

It is not necessary that the particular sequence of securing the edges of the various portions together should be as set forth above, only that the ultimate result of the various edges being secured together should be achieved.

The garments are preferably made of conventional natural or synthetic textile material.

For a better understanding of the invention, and to show how the same may be carried into effect, reference will now be made, by way of example, to the accompanying drawings in which:

FIG. 1 shows a plan view of a blank which is used to form a pullover-type garment;

FIG. 1*a* illustrates a detail of FIG. 1;

FIG. 1*b* illustrates a modification of FIG. 1;

FIG. 2 shows a plan view of a blank which is used to form a jacket;

FIG. 2*a* illustrates a modification of FIG. 2;

Figure 2:
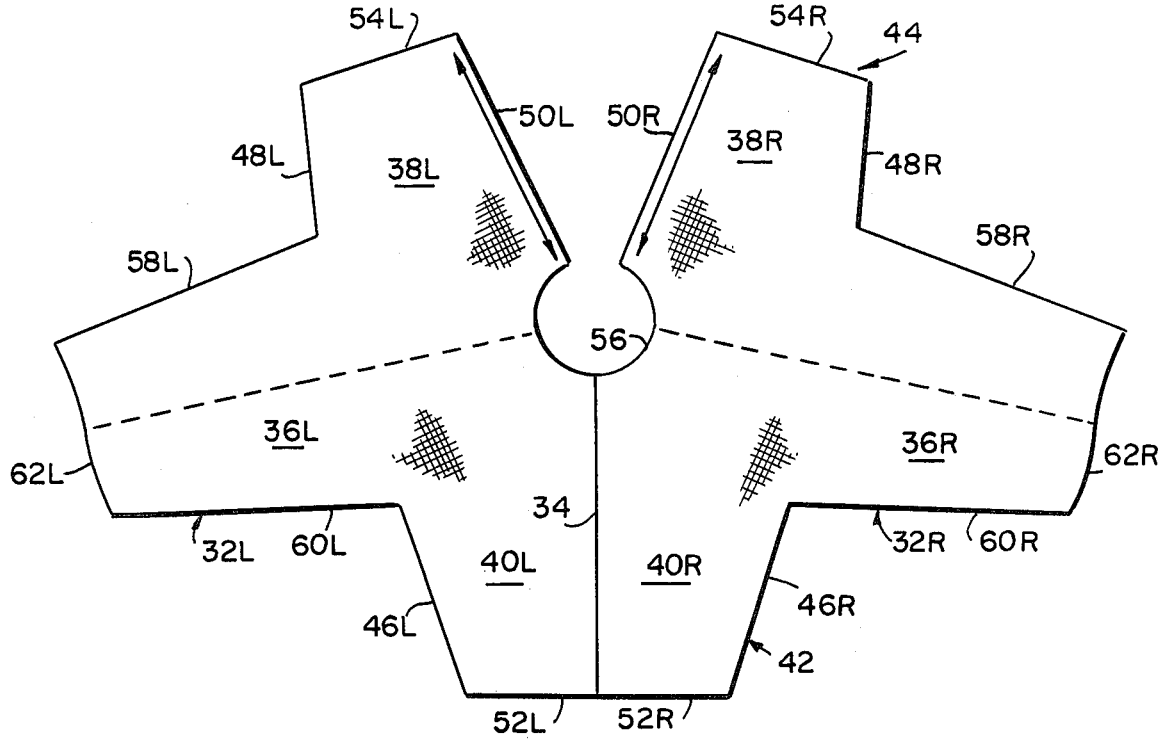

In the drawings and in the following description, reference numerals are provided with the suffix L or R to denote an element on the left or right side of the garment respectively.

FIG. 1 illustrates in plan view a blank used to form a pullover-type garment. The blank is formed from a single continuous piece of fabric and comprises a front panel 1, a back panel 2, and two sleeve panels 4. The blank defines a neck opening 5. Each of the sleeve panels has two lateral edges 8 and 10 and a cuff edge 12.

The front panel has two lateral edges 14 and a bottom edge 16. The back panel has two lateral edges 18 and a bottom edge 20. It will be seen that the back panel 2 is in fact in two parts 2L and 2R, bounded by respective inner edges 22L and 22R which extend from the neck opening to the bottom edge.

It will be seen from FIG. 1 that the two inner edges 22R and 22L of the back panel parts 2R and 2L converge towards the neck opening at an angle of about 43° and are substantially perpendicular to the two halves 20R and 20L of the bottom edge of the back panel. The lateral edges 18 converge towards the bottom edge of the back panel at an angle of about 5°.

The lateral edges 14 of the front panel 1 converge towards the bottom edge 16 at an angle of about 35°, and an angle of about 100° is included between the edges 14 and the lateral edges 8 of the adjacent sleeve panels. The lateral edges 8 and 10 of each sleeve panel converge towards the cuff edge 12 at an angle of about 23°, and an angle of about 117° is included between the lateral edge 10 of each sleeve and the adjacent lateral edge 18 of the back panel.

In order to produce the pullover-type garment, the inner edges 22 of the back panel are sewn together, preferably including iron-on bias tape 24 on each side of the seam, as illustrated in FIG. 1*a*, the lateral edges 8 and 10 of each sleeve are sewn together, and the lateral edges 14 and 18 of the front and back panels are sewn together. The resulting garment has two sleeves and a body portion. The body portion has a bottom edge formed by the bottom edges 16 and 20 of the front and rear panels. The cuff edges of the sleeves and the bottom edge of the body portion are finished in whatever manner is desired.

It will be appreciated that it is not essential to secure the various edges together in the sequence indicated above.

The blank illustrated in FIG. 1 may be modified by providing on each of the lateral edges 8 and 10 of the sleeve panels 4, small triangular projections 26 and 28 having concaved sides, as shown in FIG. 1*b*, and further providing two gusset panels 30. The gusset panels are of square, diamond or kite-like shape, having two pairs of adjacent sides a,b and c,d of equal length. When forming the garment from the blank 1 and the gusset panels 30, the inner edges 22 are secured together as before but instead of securing the various lateral edges together along their entire lengths the gusset panels are incorporated where the lateral edges of the sleeves meet the lateral edges of the front and back panels. Thus, the lateral edges 8 and 10 of each sleeve are secured together over their entire length from the cuff edge to the points of the projections 26 and 28, and the adjacent edges a and b of the gusset blank 30 are secured to the lateral edges 8 and 10 from the points of the projections 25 and 28 to the points at which the lateral edges 8 and 10 meet the edges 14 and 18 respectively. It will be appreciated that the distance along the edge 8 from the point of the projection 26 to the cuff edge 12 is equal to the distance along the edge 10 from the peak of the projection 28 to the cuff edge 12, and that the distance along the edge 8 from the peak of the projection 26 to the point at which the edge 8 meets the edge 14 is equal to the length of the edges a and b of the gusset panel 30 and is moreover equal to the distance along the edge 10 from the point of the projection 28 to the point at which the edge 10 meets the lateral edge 18.

The edges c and d of the gusset blank 30 are secured to the lateral edges 14 and 18 of the front and back panel, and from the point at which the edges c and d meet the edges 14 and 18 are secured together.

It will be appreciated that incorporation of the gusset blanks 30 provides added freedom of movement for the arms of a wearer of the garment.

FIG. 2 illustrates two blanks 32L and 32R which are secured together along a line 34 by a seam similar to that used to secure the inner edges 22 of the back panel 2 together in the case of the garment described with reference to FIG. 1, i.e. including iron-on bias tape on each side of the seam. The purpose of including the bias tape in the seam in the case of FIG. 2 is to provide stiffening, and by use of another method of stiffening it would be possible to dispense with the seam and use a single continuous blank instead of the two blanks 32L and 32R. Moreover, in some cases the stiffening may be omitted altogether.

Each of the blanks 32 illustrated in FIG. 2 comprises a sleeve panel 36, a front panel part 38 and a back panel part 40. Since the two blanks are secured together, the two panel parts 40 combine to form a back panel 42, and the two panel parts 38 combine to form a front panel 44. The back panel 42 has lateral edges 46 while the front panel 44 has lateral edges 48, the parts 38 having inner edges 50. The parts 40 have bottom edges 52, while the parts 38 have bottom edges 54. The inner edges 50 of the parts 38 extend from the bottom edges 54 to a neck opening 56. Each of the sleeve panels 36 has two lateral edges 58 and 60 of equal length and a cuff edge 62.

The lateral edges 58 and 60 of the sleeve panels converge towards the cuff edge 62 at an angle of about 19°. The lateral edges 46 of the back panel 42 converge towards the bottom edge 52 at an angle of about 37°. The lateral edges 48 of the front panel are substantially parallel, converging towards the back panel at an angle of about 7°. The inner edges 50 converge towards the neck opening at an angle of about 38°.

The manner in which the lateral edges 46, 48, 58 and 60 are secured together will be self-evident, in view of the description above of FIG. 1. The inner edges 50 of the panel portions 38 are not sewn together but are finished and are provided with closure means, such as buttons and button holes. The resulting garment is thus a jacket having a front opening.

Figure 2A:
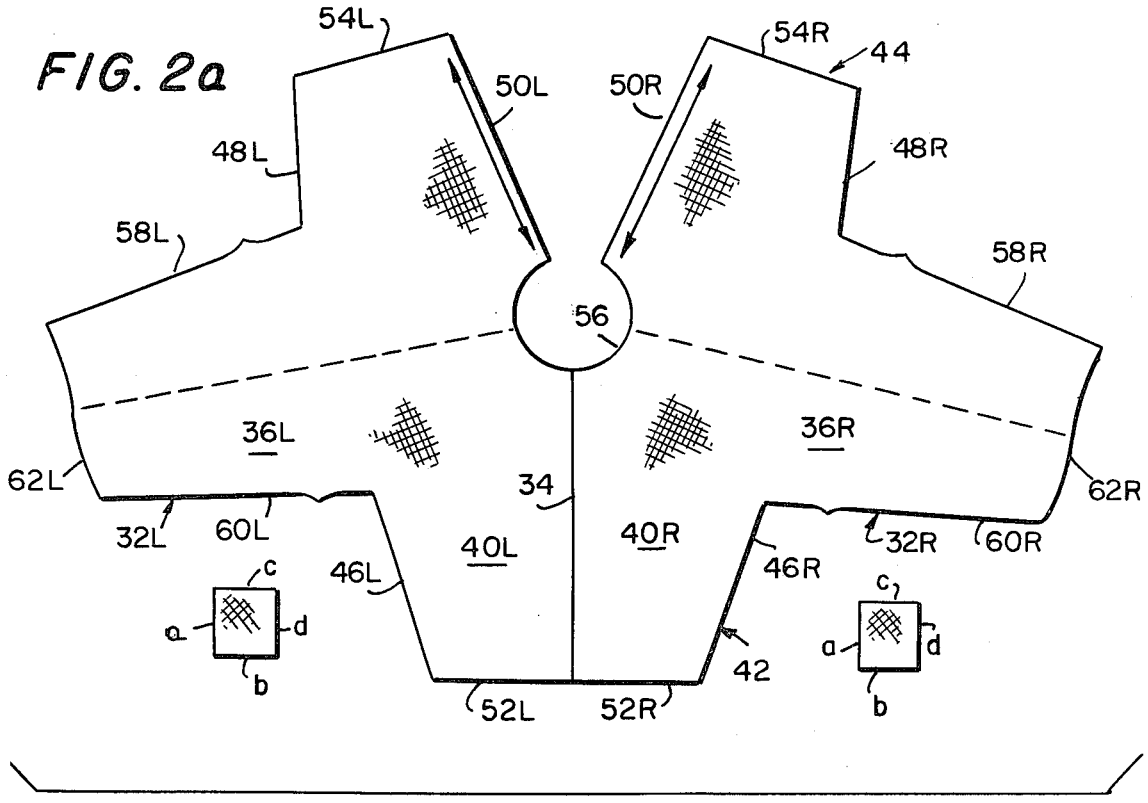

The jacket described with reference to FIG. 2 may be modified in similar manner to that in which the pullover-type garment of FIG. 1 is modified, as described with reference to FIG. 1*b*, to incorporate gussets to provide added freedom of movement for the arms of the wearer. The modification is illustrated in FIG. 2*a* and will not be described further.

Figure 3:
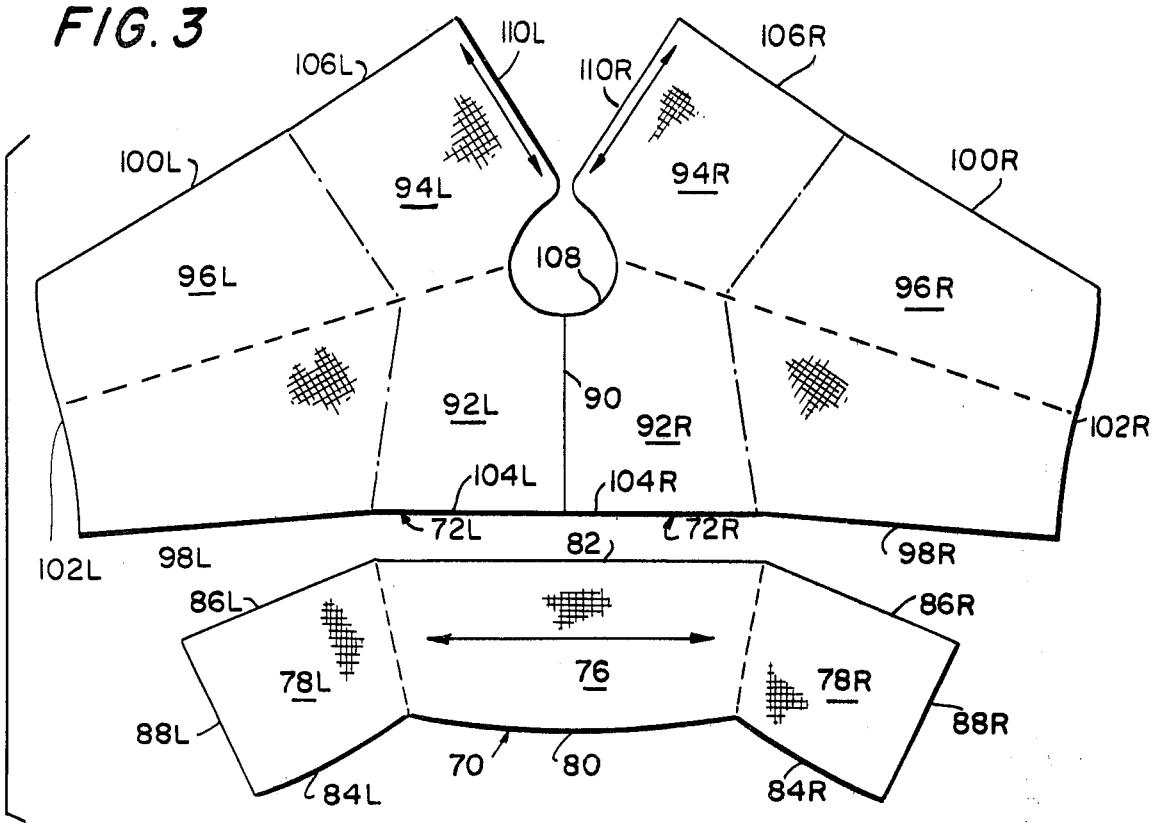
FIG. 3 shows a plan view of blanks which are used to form a jacket.

FIG. 3 illustrates three blanks 70, 72L and 72R. The blank 70 has three regions, namely a back region 76 and two front regions 78. The back region has two parallel edges 80 and 82, the edge 80 being the bottom edge of the back region and the edge 82 being the top edge thereof. The front regions 78 each have a bottom edge 84, a top edge 86 and a lateral edge 88. The edges 84 and 86 are parallel or substantially so, and are inclined to the edges 80 and 82 at an angle of about 19°. The lateral edge 88 is substantially perpendicular to the edges 84 and 86.

The blanks 72 are sewn together along a line 90 employing a seam of similar form to that described with reference to FIG. 1, i.e. with bias tape on each side of the seam. The bias tape is included in order to provide stiffening, and if some other form of stiffening were employed it would not be necessary to provide the seam and accordingly the blanks 72 could be but a single blank. Similarly, it would not be necessary to use two blanks if the stiffening were omitted altogether.

Each of the blanks 72 has a back region 92, a front region 94 and a sleeve region 96. The sleeve region has two lateral edges 98 and 100, and a cuff edge 102. The back region has a bottom edge 104 which is substantially collinear with the lateral edge 78. Similarly, the front region has a bottom edge 106 which is substantially collinear with the edge 100. The edge 104 is perpendicular to the line 90, and the edges 98 and 100 converge towards the cuff edge 102 at an angle of about 30°. The two blanks 72 define a neck opening 108, and each of the front regions 94 has an edge 110 which extends from the neck opening 108 to the edge 106. The edges 110 converge towards the neck opening at an angle of about 57°.

The blanks illustrated in FIG. 3 are used to form a jacket, by securing the edge 98 of each sleeve region 96 to the edge 100, securing the top edge 82 of the panel 70 to the edges 104L and 104R of the back regions 92, and securing the edges 86L and 86R of the blank 70 to the edges 106L and 106R respectively of the blanks 72L and 72R. The edges 70 and 84 then form the bottom edge of a body portion of a jacket and the edges 102 form the cuffs of the jacket. The bottom edge and the cuffs are finished, and fastening means, such as buttons and button holes are provided along the edges 110 of the blanks 72.

Figure 4:
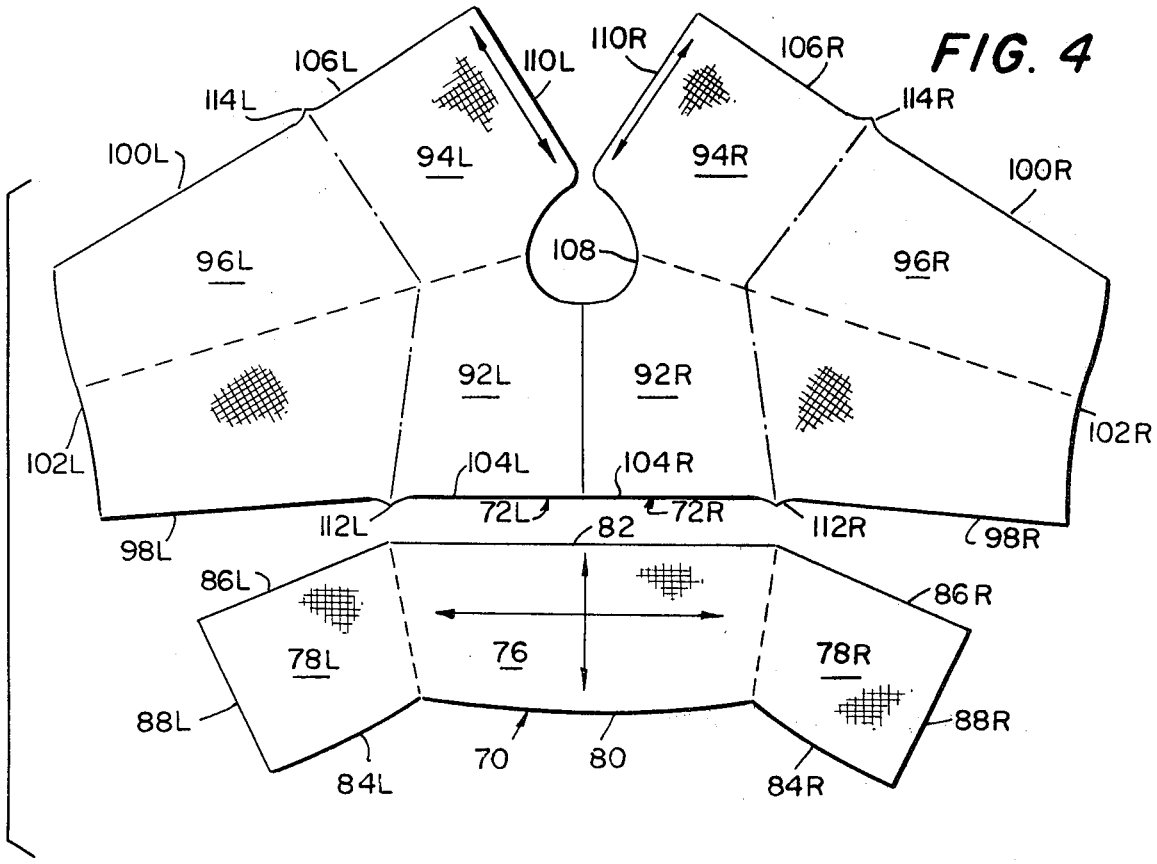
FIG. 4 illustrates a modification of FIG. 3.

FIG. 4 illustrates a way in which the blanks 72 described with reference to FIG. 4 may be modified in order to provide for additional freedom of movement for the arms of the wearer of the resolving jacket. As shown in FIG. 4, each blank 72 is provided at the juncture of the edges 98 and 104 with a substantially triangular projection, the outer sides of the triangle being concaved, and similarly the edges 100 and 106 are provided at their juncture with a triangular projection 114 having concaved sides. The point of each of the projections 112 and 114 marks the juncture of the edges 98, 104 and 100, 106 respectively; that is to say, the distance along the edge of the blank 72 from the cuff edge 102 to the point of the projection 112 is equal to the distance from the cuff edge to the point of the projection 114, the distance along the edges 104 from the point of the projection 112L to the point of the projection 112R is equal to the length of the edge 82 of the blank 70, and the distance along the edge 106 from the edge 110 to the point of the projection 114 is equal to the length of the edge 86 of the blank 70. Inclusion of the triangular projections provides additional freedom of movement for the arms of the wearer.

The jackets described with reference to FIGS. 3 and 4 are especially suitable for women, in that the seam between the edges 86 and 106 can be brought to the bust point, with the regions 78 below the bust point and the regions 94 above the bust point. This avoids the need for additional darts to accommodate the bust curvature.

In order to finish the garments completely, the neck openings are provided with collars.

It will be appreciated that the invention is not restricted to the methods and garments which have been described, and that modifications may be made without departing from the principles of the invention as defined in the appended claims.

In the case of the FIG. 1 jacket, the threads of the fabric extend parallel and perpendicular to the edge 16. In the case of FIG. 2, the threads of each blank extend parallel and perpendicular to the inner edge 50. In the case of FIGS. 3 and 4, the threads of each blank 72 extend parallel and perpendicular to the edge 110, while the threads of the blank 70 extend parallel and perpendicular to the edge 82.

I claim:

1. A method of making a jacket or similar garment using sheet-form flexible material, comprising the steps of:

(a) forming a single, main blank having a neck opening and having a front panel portion, a back panel portion and two sleeve portions all extending from said neck opening, said front panel portion and said rear panel portion each being bounded by a bottom edge and two lateral edges, and said sleeve portions each being bounded by a cuff edge and two lateral edges, and at least one of said panel portions being divided into two parts which are bounded respectively by inner edges extending in mutually converging relationship from said bottom edge to the neck opening;

(b) forming first and second gusset blanks of square, diamond or kite-like form having four sides, a first and a second side of each gusset blank being adjacent and of equal length, and a third and the fourth side of each gusset blank being adjacent and of equal length, and being adjacent the first and second sides respectively of the gusset blank;

(c) securing the first side of each gusset blank to one of the two lateral edges of the front panel portion with the corner between the first and third sides disposed at the junction of the lateral edge of the front panel portion and the adjacent lateral edge of one of the two sleeve portions;

(d) securing the second side of each gusset blank to one of the two lateral edges of the back panel portion with the corner between the second and fourth sides disposed at the junction of the lateral edge of the back panel portion and the adjacent lateral edge of one of the two sleeve portions;

(e) securing the third side of each gusset blank to the adjacent lateral edge recited in step (c) and securing the fourth side of each gusset blank to the adjacent lateral edge recited in step (d); and (f) securing the lateral edges of each sleeve portion together from the corner between the third and fourth sides of the gusset blank to the cuff edge and securing each lateral edge of the front panel portion to a corresponding lateral edge of the rear panel portion from the corner between the first and second sides of the gusset blank to the bottom edges of the front and rear panel portions.

2. A method as claimed in claim 1, wherein said one panel portion is the front panel portion whereby said inner edges define a front opening of the garment, and the method further comprises the step of providing releasable fastening means along said inner edges to enable the front opening of the garment to be closed when the garment is in use.

3. A method as claimed in claim 1, including the step of securing said inner edges together to form a pullover garment.

4. A method as claimed in claim 3, wherein said one panel portion is the rear panel portion.

5. A method as claimed in claim 1, wherein each of said lateral edges is substantially straight and the lateral edges of said one panel portion are substantially parallel, the lateral edges of the other of said panel portions converging towards said bottom edge thereof and the lateral edges of each sleeve portion converging towards the cuff edge thereof.

6. A method as claimed in claim 5, wherein the lateral edges of said other panel portion converge at an angle in the range from about 32° to about 40°.

7. A method as claimed in claim 5, wherein the inner edges of said one panel portion converge towards the neck opening at an angle in the range from about 35° to about 45° and the lateral edges of said one panel portion converge towards the bottom edge thereof at an angle in the range from about 7° to about −10°.

8. A method as claimed in claim 5, wherein the lateral edges of each sleeve portion converge towards the cuff edge thereof at an angle in the range from about 15° to about 26°.

9. A method as claimed in claim 5, wherein each lateral edge of said other panel portion meets the lateral edge of the adjacent sleeve portion in an angle in the range from about 70° to about 85°.

10. A method as claimed in claim 5, wherein each lateral edge of said one panel portion meets the lateral edge of the adjacent sleeve portion in an angle in the range from about 60° to about 78°.

11. A method as claimed in claim 1, wherein the lateral edges of each of said sleeve portions are substantially straight except that each sleeve portionn is provided at each lateral edge with a substantially triangular projection further from the cuff edge of the sleeve portion than from the junction between the lateral edge of the sleeve portion and the lateral edge of the adjacent panel portion, the distance between the point of the projection and said junction being substantially equal to the length of said third and fourth sides of the gusset blank.

12. A method as claimed in claim 11, wherein the sides of the projection are concaved.

13. A method as claimed in claim 1, wherein the blank recited in step (a) is formed by two continuous portions of sheet-form flexible material which meet in a seam extending perpendicular to the bottom edge of the other of said panel portions from said bottom edge to said neck opening.

14. A method as claimed in claim 13, wherein said seam is reinforced by means of bias tape provided on each side of the seam.

15. A method of making a jacket or similar garment from sheet-form flexible material, comprising the steps of:

(a) forming a single blank bounded by three major edges and having a neck opening and also having a back region, a front region and two sleeve regions, the front region being in two portions bounded by first parts of a first and a second of said major edges respectively and also being bounded by respective inner edges which extend from adjacent ends of said first and second major edges to the neck opening, the back region being bounded by a first part of the third major edge, and the sleeve regions being bounded by respective parts of the third major edge, parts of the first and second major edges respectively, and respective cuff edges;

(b) forming a second blank having two major edges and two minor edges, one of the major edges having an intermediate region substantially equal in length to said first part of the third major edge of the first blank and two end regions substantially equal in length to said first parts of said first and second major edges respectively, and the other major edge having three regions extending substantially parallel respectively to the three regions of said one major edge;

(c) securing the intermediate region and the two end regions of said one major edge of the second blank to, respectively, said first part of the third major edge of the first blank and said first parts of the first and second major edges of the first blank, securing together the parts of the first and third major edges of the first blank bounding one sleeve region and the parts of the second and third major edges of the first blank bounding the other sleeve region.

16. A method as claimed in claim 15, wherein said first, second and third major edges of the first blank are substantially straight, except that the first and second major edges are each formed with one substantially triangular projection, the points of which define the junctures between the two portions of the front region and the sleeve regions respectively, and the third major edge is formed with two substantially triangular projections, the points of which define the junctures between the back region and the sleeve regions respectively.

17. A method as claimed in claim 15, wherein the first blank is formed by two continuous portions of sheet-form flexible material which meet in a seam extending perpendicular to the third major edge thereof from said third major edge to the neck opening.

18. A method as claimed in claim 17, wherein said seam is reinforced by means of bias tape provided on each side of the seam.

19. A method as claimed in claim 15, wherein said first, second and third major edges are substantially straight, said first and third major edges converging towards one cuff edge at an angle in the range from about 28° to about 34° and said second and third major edges converging towards the other cuff edge at an angle in the range from about 28° to about 34°, and wherein said inner edges converge towards said neck opening at an angle in the range from about 62° to about 68°.

20. A method as claimed in claim 15, wherein the two end regions of said one major edge of the second blank are oriented at an angle in the range from about 25° to about 31° to the intermediate region thereof.

21. A garment made by a method as claimed in claim 1 or 15.

* * * * *